US005120088A

United States Patent [19]

Radcliffe et al.

[11] Patent Number: 5,120,088

[45] Date of Patent: Jun. 9, 1992

[54] METHOD OF SECURING A TRANSACTION RECORD

[75] Inventors: William W. Radcliffe, Pitman; Gerald H. Haney, Skillman, both of N.J.

[73] Assignee: New Holding, Inc., Stamford, Conn.

[21] Appl. No.: 640,197

[22] Filed: Jan. 11, 1991

[51] Int. Cl.[5] ..... B42D 15/00

[52] U.S. Cl. ..... 283/67; 283/92

[58] Field of Search ..... 283/67, 92

[56] References Cited

U.S. PATENT DOCUMENTS

| | | | |
|---|---|---|---|
| Re. 27,770 | 10/1973 | Siegel | 283/92 X |
| 1,727,912 | 9/1929 | Snyder | 283/58 X |
| 4,066,280 | 1/1978 | LaCapria | 283/92 X |
| 4,957,312 | 9/1990 | Morello . | |

FOREIGN PATENT DOCUMENTS

| | | | |
|---|---|---|---|
| 33499 | 3/1977 | Japan | 283/92 |

*Primary Examiner*—Paul A. Bell

*Attorney, Agent, or Firm*—Caesar, Rivise, Bernstein, Cohen & Pokotilow, Ltd.

[57] ABSTRACT

A method of securing a transaction record from counterfeiting is disclosed. The method comprises providing an ink ribbon for a transaction record which is impregnated with an ink containing a fluorescent material and a vehicle which is highly absorptive. A transaction record paper is provided which is at least moderately porous so that the ink contacts both sides of the paper when applied only to one side of the paper. The transaction record is fluorescable under black light on both the front and rear of the transaction record.

3 Claims, No Drawings

METHOD OF SECURING A TRANSACTION RECORD

BACKGROUND OF THE INVENTION

The invention relates generally to a method of securing a transaction record from counterfeiting, and more particularly to the use of a printing ribbon having a fluorescent component which is visible under black light.

BACKGROUND ART

A problem which has become prevalent in retailing is the reproduction of sales transaction records, such as sales receipts. One of the ways in which retailers have been losing money is the use of xerographic copies by customers to reproduce sales receipts to enable refunds from the retailer for devices not actually purchased from the retailer.

That is, one method which has been used is to purchase an item off the shelf and obtain a sales receipt. The sales receipt is then duplicated by a duplicating machine and then the purchaser returns not only the device that was purchased from the retail operation, but also has a confederate pick up a device off the shelf and return it to the cash register with the duplicated sales receipt to get an additional refund. Accordingly, there is a substantial need for a sales receipt which is not easily duplicated and which is easy to distinguish from a copy which has been made from the sales receipt.

A system which is the subject of U.S. Pat. No. 4,957,312, issued Sep. 18, 1990 to Peter S. Morello of Plymouth, Mass., shows a method of printing a sales record by use of printing in different colors. A split ribbon is provided which is so disposed with respect to the characters printed that the top half of the characters is printed in one color and the lower half is printed in a different color.

However, with the advent of color duplicating machines, even this system does not protect or secure a transaction record from being used to make duplicate receipts.

OBJECTS OF THE INVENTION

It is the general object of the invention to provide a method of securing a transaction record from counterfeiting which overcomes the disadvantages of the prior art.

It is a further object of this invention to provide a method of securing a transaction record from counterfeiting which includes providing a ribbon for transaction record printers which is impregnated with an ink containing a fluorescent material and a vehicle which is highly absorptive.

It is still a further object of this invention to provide a method of securing a transaction record from counterfeiting which includes a transaction record paper which is at least moderately porous so that ink contacting one side of the surface will absorb through and be in contact with both sides of the paper though applied only to one side of the paper.

It is still a further object of the invention to provide a method of securing a transaction record which transaction record has components which are visible under black light on both the front and rear of said transaction record to secure the transaction record.

SUMMARY OF THE INVENTION

These and other objects of the instant invention are achieved by providing a method of securing a transaction record from counterfeiting. The method comprises providing an ink ribbon for a transaction record printer. The ribbon is impregnated with an ink containing a fluorescent material and a vehicle which is highly absorptive. The method further comprises providing a transaction record paper which is at least moderately porous so that the ink contacts both sides of the paper when applied only to one side of the paper. The transaction record is visible under black light on both the front and rear of the transaction record.

DETAILED DESCRIPTION OF THE PREFERRED EMBODIMENT

The invention utilizes point of sale ribbons for automatic teller machines, cash registers and other transaction record printers containing an ink which include a fluorescent material. The fluorescent material is part of the dye and is therefore soluble in the vehicle of the ink. The dyes and vehicles used in the ink for the ribbon preferably have highly absorbative properties so that it can penetrate easily in moderately porous paper.

The ink impregnated in the printing ribbon may be made in several different colors such as blue, purple, brown, red, orange, green or black.

When the ink is purple for example, it comprises 11% N-tallow alkyltrimethylenediamines oleates, 30% of a fluorescent dispersion, 17% of mixed fatty esters, 31% of a color dispersion and 11% of laked triarylmethane dye.

There are conventional fluorescent dispersions available which are operative with the proper vehicle to be highly absorbable in paper and enable the fluorescent dispersion to penetrate not only the side which is initially contacted of the transaction record papers but also absorbed into the material for visibility on the reverse side.

The paper used in the point of sale machines for printing the transaction records must have a reasonable amount of porosity so that when the ink from the ribbon is applied to one surface of the transaction record paper, the papers absorbs the dye and the vehicle in the ink containing the fluorescent component. Thus, both the front and rear surface of the transaction record paper contains the fluorescent material.

The method utilizes the provision of such a ribbon containing fluorescent material and a black light or near ultraviolet light which is used to inspect the transaction record when it is returned for a refund. By use of the black light the characters on the front side are made visible by energizing of the fluorescent ink. Similarly, the fluorescent materials reaching the rear side are also energized so that the inspection of the transaction record is very quick and easy to determine whether the transaction record is an original or a counterfeit.

Even if a counterfeiter attempted to provide fluorescent material to the toner of a duplicating machine, without the use of a highly absorbable vehicle in the toner, the toner does not go through the paper in order to provide the fluorescable material on both sides of the transaction record paper.

Further, it has been found that because of the filtering effect by the paper when fluorescent ink is provided on one side of the paper, it fluoresces in a different color on the reverse side of the paper under black light.

It can therefore be seen that a new and improved method of securing a transaction record from counterfeiting has been provided. The method uses the characteristics of paper as an absorbent medium not only to receive the fluorescent material with the ink on one side, but also to filter the same for providing a different color on the reverse side when energized by black light.

Also, because the ribbon is replaced for the normal printing ribbon in the transaction record printers, the system is easy to implement and inexpensive to use. The use of a black light is also not only inexpensive to provide in connection with such a method, but also is easy to use for determining whether the transaction record is real or a counterfeit.

Without further elaboration the foregoing will so fully illustrate my invention that others may, by applying current or future knowledge readily adopt the same for use under various conditions of service.

We claim:

1. A method of securing a transaction record from counterfeiting comprising the steps of:

(a) providing an ink ribbon for a transaction record printer, said ribbon being impregnated with an ink containing a fluorescent material and a vehicle which is highly absorptive;

(b) providing a transaction paper which is at least moderately porous so that said ink is visible as a first color through the front side of said paper and is visible as a second color through the rear side of said paper when applied only to one of said sides, when said transaction record is exposed to black or near ultraviolet light on either the front or rear sides of said transaction record;

(c) printing indicia on said transaction paper utilizing said ribbon; and (d) inspecting said indicia under black or near ultraviolet light.

2. The method of claim 1 additionally comprising the step of selecting said fluorescent material to be part of the dye used in said ink.

3. The method of claim 1 additionally comprising the step of utilizing said ribbon in point of sale transaction record printers.

* * * * *